United States Patent [19]

Fichter et al.

[11] Patent Number: 4,900,008

[45] Date of Patent: Feb. 13, 1990

[54] SHEET CLAMPING ARRANGEMENT FOR ROTATABLE DRUMS

[75] Inventors: June C. Fichter, Canton; Kenneth A. McAuley, Boston, both of Mass.

[73] Assignee: Polaroid Corporation, Cambridge, Mass.

[21] Appl. No.: 34,665

[22] Filed: Apr. 6, 1987

Related U.S. Application Data

[63] Continuation-in-part of Ser. No. 945,287, Dec. 22, 1986, abandoned.

[51] Int. Cl.[4] ..... B65H 5/12

[52] U.S. Cl. ..... 271/277; 271/82; 101/409

[58] Field of Search ..... 271/82, 184, 204, 205, 271/206, 268, 277; 101/409, 410, 411, 412, 415.1, 229, 230, 231; 198/379, 803.1

[56] References Cited

U.S. PATENT DOCUMENTS

| | | | |
|---|---|---|---|
| 3,348,288 | 10/1967 | Tanguay et al. | 29/118 |
| 3,567,213 | 3/1971 | Lagonegro et al. | 271/3 |
| 3,591,169 | 7/1971 | Preuss | 271/50 |
| 3,654,624 | 4/1972 | Becker et al. | 340/173 LM |
| 3,744,791 | 7/1973 | Bongers | 271/80 |
| 3,843,114 | 10/1974 | Kojima et al. | 271/3 |
| 3,854,715 | 12/1974 | Coleman | 271/277 |
| 3,865,362 | 2/1975 | Luffy et al. | 271/82 |
| 3,871,645 | 3/1975 | Buttner et al. | 271/270 |
| 3,884,461 | 5/1975 | Hauser | 271/277 |
| 3,903,795 | 9/1975 | Suzuki | 101/409 |
| 3,918,707 | 11/1975 | Villemer et al. | 271/277 |
| 3,924,848 | 12/1975 | Murakami | 271/10 |
| 4,024,814 | 5/1977 | Becker | 101/410 |
| 4,033,575 | 7/1977 | Fujimoto | 271/3 |
| 4,072,306 | 2/1978 | Idstein | 271/3 |
| 4,073,489 | 2/1978 | Idstein et al. | 271/277 |
| 4,120,263 | 10/1978 | Boschet | 118/657 |
| 4,135,198 | 1/1979 | Fujimoto | 346/138 |
| 4,138,102 | 2/1979 | Palmer | 271/3 |
| 4,179,118 | 12/1979 | Huss | 271/277 |
| 4,202,268 | 5/1980 | Becker | 101/409 |
| 4,225,872 | 9/1980 | Marinoff | 346/75 |
| 4,250,810 | 2/1981 | Fowler et al. | 101/410 |
| 4,259,695 | 3/1981 | Nakano | 358/291 |
| 4,390,176 | 6/1983 | Kato | 271/270 |
| 4,517,575 | 5/1985 | Kakimoto et al. | 346/138 |

OTHER PUBLICATIONS

"Mechanism and Actuator for Clamping Sheets on a Drum", Barber et al., IBM Tech. Disclosure Bulletin, vol. 23, No. 7A, 12-1980, pp. 2679-2682.

*Primary Examiner*—Joseph J. Rolla
*Assistant Examiner*—Edward S. Ammeen
*Attorney, Agent, or Firm*—Karl Hormann; Robert L. Berger; Robert F. Ziems

[57] ABSTRACT

A sheet clamping system for rotatable drums especially suited for use in retaining and positioning successive receiver sheets for high speed printers. The clamping system enables unidirectional movement of a sheet during delivery of the sheet to the drum from a supply stack, during clamping of the leading edge of the sheet to the drum followed by clamping of the trailing edge of the same sheet to the drum and during subsequent release and delivery of the sheet to a receiving stack or tray. The system features a cam system for actuating respective leading and trailing edge clamps which is supported on the same shaft to which drum driving rotation is supplied by a drive motor. In one embodiment where the drive motor is reversible, a one-way clutch connection of the drum to the shaft enables drum rotation during one rotational direction of the shaft whereas clamping bar actuation is effected by rotation of the shaft in the opposite direction while holding the drum. In an alternative embodiment, the drum is fixed to the shaft which is driven in a working direction only by a first relatively high speed motor, the cam system is rotatable on the shaft, and a second relatively slow speed stepping motor drives the cam system and the drum during sheet loading and unloading operations.

31 Claims, 10 Drawing Sheets

SHEET CLAMPING ARRANGEMENT FOR ROTATABLE DRUMS

CROSS-REFERENCE TO RELATED APPLICATION

The present application is a continuation-in-part of copending application Ser. No. 945,287, filed Dec. 22, 1986, now abandoned.

BACKGROUND OF THE INVENTION

This invention relates to sheet handling drums and, more particularly, it concerns an unique sheet clamping arrangement by which the leading and trailing edges of a sheet fed from a supply tray or stack are clamped to a drum for the performance of a printing operation, for example, delivered from the drum to a delivery tray or stack, and the drum and clamping arrangement repositioned to receive another sheet.

The prior art relating to rotatable sheet handling drums and clamp-like retention devices for holding a sheet on a drum is highly developed in machinery involving a transfer of some media to or from the drum retained sheet. In many types of printing machines, for example, the drum retained sheet may control transfer of ink to a succession of receiver sheets whereas in various recording machinery, the drum retained sheet receives ink or its equivalent from a stylus or other writing device. In this latter type of machinery, the support of the receiving sheet by the drum permits accurate angular registration of the sheet with respect to a writing device usually supported by a carriage for movement axially of the drum.

The support provided by the cylindrical surface of a drum combined with the capability for accurate angular registration at relatively high speeds makes a rotatable drum support for receiver sheets an excellent candidate for use in computer driven electronically controlled printers. A major obstacle to this use of sheet retaining drums, however, is presented by problems associated with securement of the sheet to the drum periphery in a manner which does not crease, fold or otherwise deform the sheet and also in delivery of the sheet from the drum after a work cycle is completed.

U.S. Pat. Nos. 4,033,575 and 4,259,695 contain disclosures of clamping apparatus for retaining a sheet about the periphery of a rotatable drum and by which the leading and trailing edges of the sheet are successively clamped by independently movable clamping bars. In the disclosures of both of these patents, the leading edge of a sheet fed tangentially to the drum is first seized by a leading edge clamping bar rotatable at all times with the drum. While the trailing edge clamp is held against movement, the drum and the leading edge clamp draw the sheet past the trailing edge clamp until the trailing edge of the sheet registers with the latter clamp. The trailing edge clamp is then closed on the sheet and rotates with the drum during a sheet processing cycle.

The drum sheet clamping arrangements shown in the aforementioned patents, in principle, are desirable from the standpoint of providing a firm clamping action at opposite ends of a sheet, of enabling the clamping action to occur during drum rotation in one direction, and of avoiding any need for folding, creasing or otherwise mutilating the sheet. On the other hand, the mechanisms required for operation of the clamping apparatus disclosed in these patents are complicated and tend to restrict use of the apparatus to relatively slow-speed facsimile machines. In addition, the disclosed clamping apparatus does not operate by itself to discharge the sheet from the drum.

There is, therefore, a need for improvement in the drum sheet clamping apparatus heretofore disclosed in order to adapt rotatable drum sheet supports to machinery such as computer driven printers to and from which successive print receiving sheets are fed and discharged automatically.

SUMMARY OF THE INVENTION

In accordance with the present invention, an improved sheet clamping system for rotatable drums is provided by which the leading edge of each of a succession of sheets fed to the drum periphery is engaged and clamped in position by a leading edge clamp rotatable at all times with the drum, the sheet is drawn past a trailing edge clamp capable of retention in a fixed position during drum rotation, the trailing edge of the sheet is engaged by the trailing edge clamp for continued rotation of the drum for a printing operation, for example, the sheet is discharged from the drum by the trailing edge clamp, and the drum and both clamps indexed to receive another sheet. The system features a cam actuating mechanism for moving each of the clamps between sheet clamping a sheet releasing positions, which cam mechanism requires a minimal number of components and which may be operated by the same motor used to rotate the drum, or alternatively, by a motor dedicated to sheet loading and unloading operations where very high speed printing operation and close drum indexing tolerances require a separate motor for driving and indexing the drum during printing.

The invention is embodied in a structural organization including a drum and a pair of end caps supported for rotation independently on a common central shaft journalled for rotation in spaced end supports and driven by a reversible electric stepping motor. A pair of clamping bars extend axially of the drum at the periphery thereof and are supported respectively by pairs of brackets, one such pair being rotatable at all time with the drum whereas the other such bracket pair is rotatable at all times with the end caps. The one of the two clamping bars functioning as the leading edge clamp is supported from the brackets connected for rotation with the drum. The trailing edge clamp, on the other hand, is retained at its ends by brackets supported from the end caps. At the axial position of the respective brackets at each of opposite ends of the drum, a cam set is mounted on the central supporting shaft. Each cam set cooperates with internal cam tracks on the respective brackets and circumscribing the axis of the central shaft. The cam sets and cooperating cam tracks or equivalent function to move the clamping bars from a clamping position against the drum periphery to a retracted position spaced from the drum periphery. Although as indicated, the leading edge clamp rotates at all times with the drum, the trailing edge clamp, being supported from the end caps, may be retained against movement with respect to the drum in its retracted position spaced from the drum periphery but will rotate with the drum at all times when in a clamping or sheet engaging position against the drum periphery.

In one embodiment intended for application with text line printers and other such applications where moderate drum speeds and drum indexing tolerances are incurred, the common central supporting shaft is driven by a single reversible electric stepping motor both during the sheet loading and unloading operation and during rotational movement of the drum with a mounted sheet during a printing operation, for example. In this instance, the drum is coupled to the shaft by a one-way clutch so that the drum rotates directly with the shaft during one direction of shaft rotation but may be held stationary upon rotation of the shaft in the reverse direction. In another embodiment, intended for very high speed drum rotation and accurate drum indexing registration, as may be required for graphic printing operations, for example, the drum is coupled directly to the shaft for rotation at all times therewith and the shaft driven during printing operations by one motor which is designed for use only during printing operations. While the organization of the clamping bar brackets and cam sets is substantially the same as in the previously mentioned embodiment, a second relatively low speed reversible stepping motor is provided for driving the drum during sheet loading and unloading operations. The latter motor is coupled to the drum supporting shaft by gearing including a one-way clutch so that operation of the drum and end caps, as well as the cooperation between the clamp retaining brackets and the cam sets, remain substantially unchanged from the first mentioned embodiment.

A principal object of the present invention is therefore the provision of a sheet handling drum and clamping system by which individual sheets may be fed to the drum from a supply stack, clamped to the drum and ultimately delivered by actuation of the clamping system to a receiving stack. Another object of the invention is to provide such a drum and sheet clamping system which requires a minimal number of parts for effective operation. Still another object of the present invention is the provision of an improved cam actuating system by which a pair of clamping bars may be operated with respect to the periphery of a drum to retain and eject a sheet therefrom. Other objects and further scope of applicability of the present invention will become apparent from the detailed description to follow taken in conjunction with the accompanying drawings in which like parts are designed by like reference numerals.

BRIEF DESCRIPTION OF THE DRAWINGS

FIGS. 9A–15A are schematic illustrations of the cam actuating system of the present invention in various operating conditions;

FIGS. 9B–15B are schematic illustrations corresponding to the illustrations of FIGS. 9A–15A but showing the position of clamping bars at the respective cam positions illustrated in FIGS. 9A–15A;

DETAILED DESCRIPTION OF THE PREFERRED EMBODIMENTS

Figure 1:
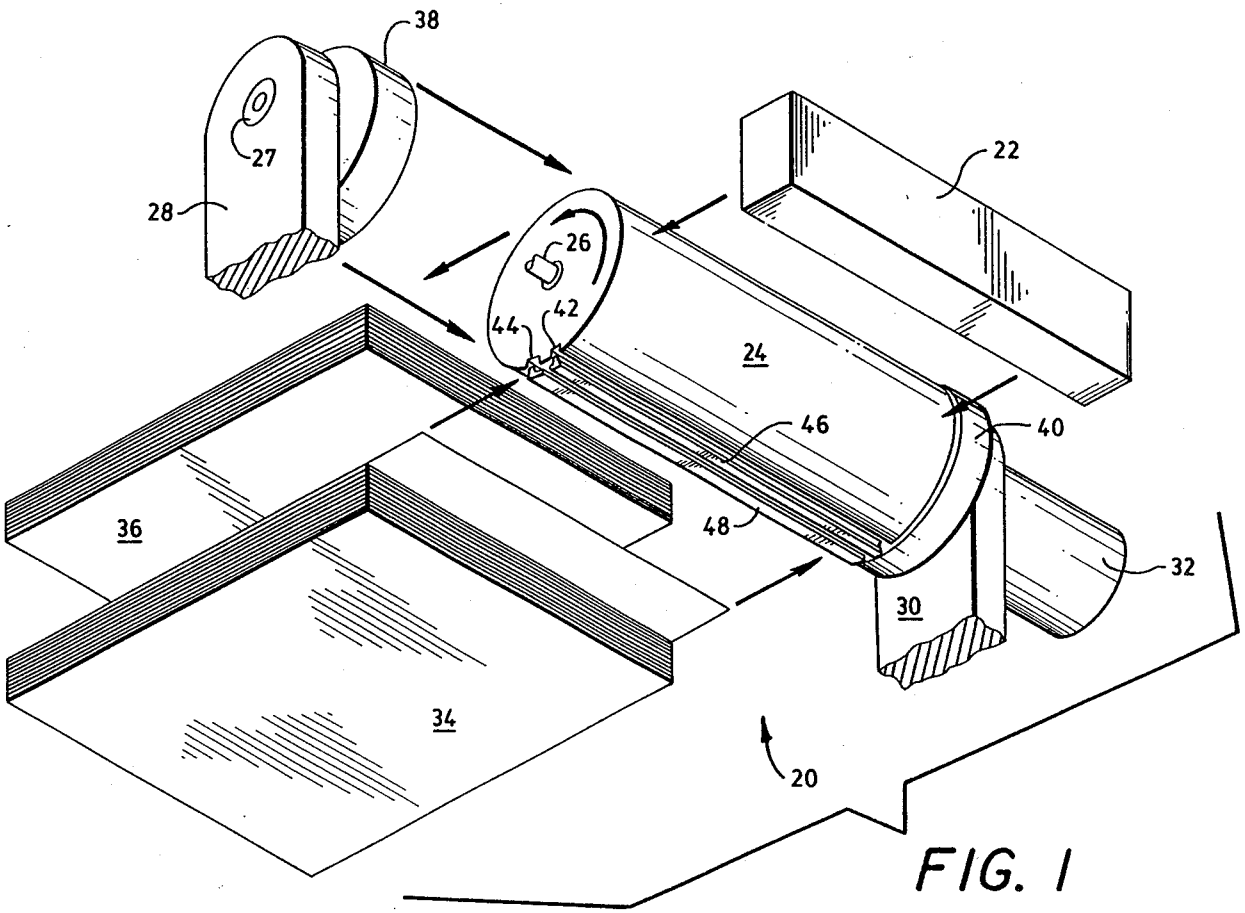
FIG. 1 is a partially exploded perspective view illustrating in somewhat schematic form the principal components of a printer incorporating the present invention and as seen from the bottom right.

In FIG. 1 of the drawings, the reference numeral 20 generally designates a printer including a print head assembly 22, a sheet retaining drum 24 supported by a central shaft 26 journalled by bearings 27 in axially spaced supports 28 and 30, and a drive motor 32 carried by the support 30. A supply stack 34 of sheets to be printed is shown positioned under a delivery stack 36 of the same sheets after printing. Obviously the stacks 34 and 36 will be supported in trays or the equivalent of trays which are not shown in the interest of clarity.

Although structural components carried by the drum 24 will be described in detail below, in FIG. 1, the drum is shown to be positioned between a pair of end caps 38 and 40 supported by the shaft 26 to be coaxial with the drum 24 but rotatable independently of the drum 24 on the shaft 26. Also, the drum 24 is provided with a pair of axial slots 42 and 44 in its cylindrical surface. A leading edge clamping bar 46 is positioned at the radial plane of the slot 42 whereas a trailing edge clamping bar 48 is similarly positioned at the radial plane of the slot 44. The bars 46 and 48 are parts of a sheet clamping system by which a sheet fed from the supply stack 34 may be clamped at its leading and trailing edges about the periphery of the drum 24.

Figure 2:
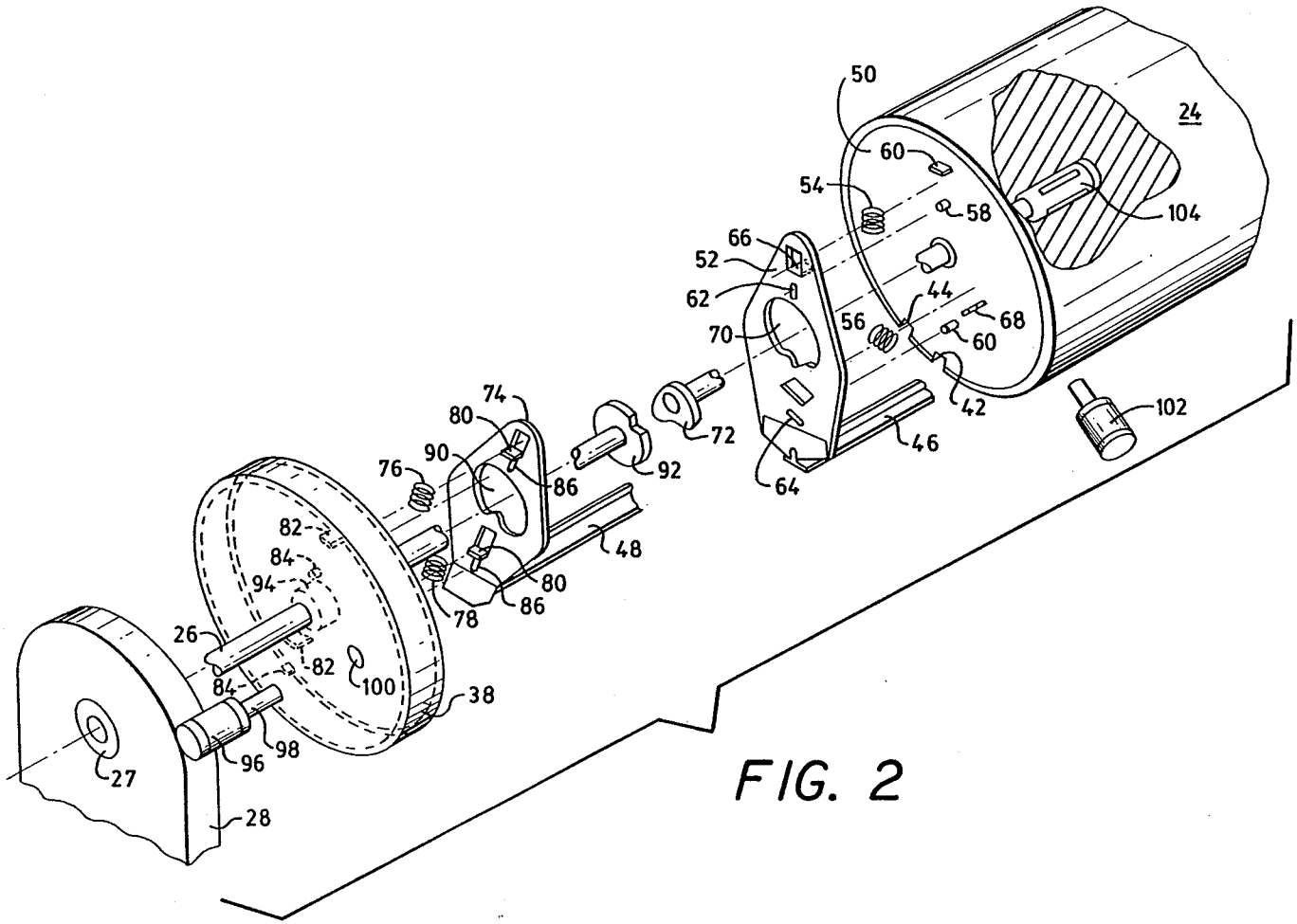
FIG. 2 is an exploded perspective view illustrating the assembly of components at one end of a sheet retaining drum incorporating one embodiment of the clamping system of the present invention.

In FIG. 2 of the drawings, components positioned between one end face 50 of the drum 24 and the end cap 38 in one embodiment of the invention are illustrated in exploded perspective as spaced along the axis of the shaft 26. The components shown in FIG. 2 are substantially duplicated between the opposite end of the drum 24 and the end cap 40 but not illustrated in the drawing inasmuch as the structural conformation and operation of the unillustrated components are identical to those shown in FIG. 2.

Figure 3:
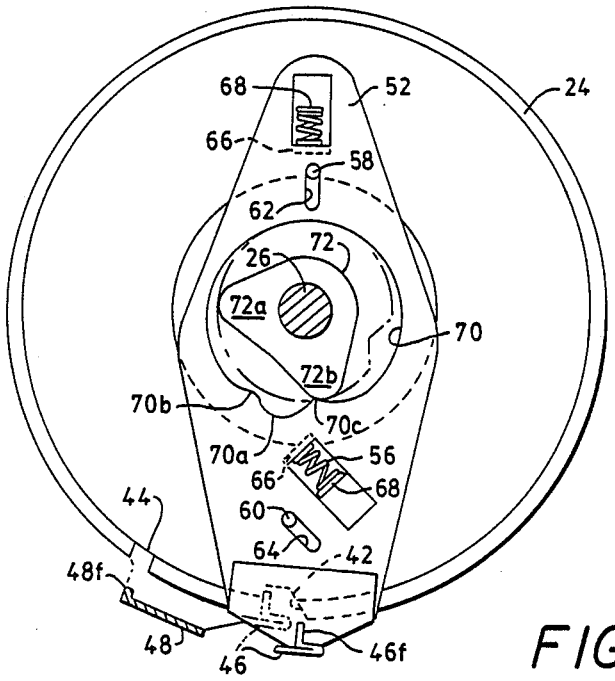
FIG. 3 is an end elevation in partial cross section illustrating one end of a sheet supporting drum incorporating the invention.
Figure 4:
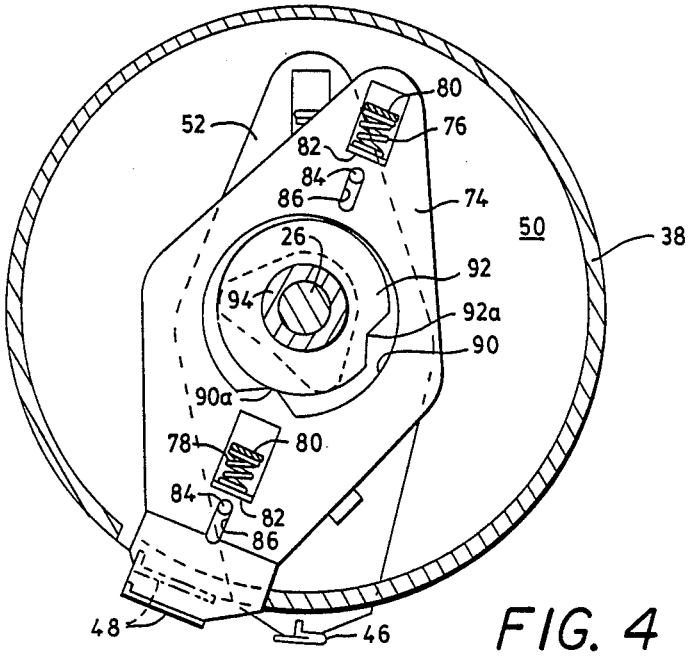
FIG. 4 is an end elevation in partial cross section through an end cap of the invention and showing the superimposition of brackets, one of which is shown in FIG. 3.

The leading edge clamping bar 46 is connected at opposite ends to a pair of brackets, one such bracket being designated by the reference numeral 52 in FIG. 2 as well as in FIGS. 3 and 4 of the drawings. The bracket 52 is mounted against the end face 50 of the drum 24 and supported in position thereon by compression springs 54 and 56 and by pins 58 and 60 projecting from the end face 50 through slots 62 and 64, respectively, in the bracket 52. The compression springs 54 and 56 are captured between tabs 66 on the bracket 52 and tabs 68 on the drum end face 50.

As may be appreciated from the illustration of FIG. 3, the springs 54 and 56 will bias the bracket 52 to a position in which the pins 58 and 60 bear against one end of the slots 62 and 64, respectively unless otherwise restrained or moved against the spring bias. In the position of the bracket 52 shown in FIG. 3, the clamping bar 46 is spaced away from the periphery of the drum 24 in an open or retracted position. It will be noted also in FIG. 3 that while the slot 62 in the bracket 52 is generally radial in orientation, the slot 64 is at an angle to a radial plane through the axis of the supporting shaft 26 so that if the bracket 52 is moved from the illustrated position under the bias of the compression springs 54 and 56, the angular orientation of the slot 64 will cause the clamping bar 46 to move from the retracted position illustrated, through a correspondingly angular path toward the periphery of drum 24 to a closed or sheet clamping position against the drum periphery. This position of the clamping bar 46 is shown in phantom lines in FIG. 3.

The bracket 52 is formed with a generally circular internal cam track 70 which cooperates with a twin-lobed cam 72 keyed or otherwise fixed for rotation at all times with the shaft 26 in an axial position to lie generally in the plane of the bracket 52. While the manner in which the cam 72 cooperates with the track 70 will be described in more detail below, it will be noted in FIG. 3 that the cam 72 has a pair of eccentric lobes **72*a* and 72*b* of equal throw and that the track 70, while generally circular, is shaped to establish a lobe recess 70*a* between a pair of track ledges or shoulders 70*b* and 70*c*. It will be seen, therefore, that when either of the cam lobes 72*a* or 72*b* lie on the track ledges 70*b* or 70*c*, the bracket 52 will be positioned against the bias of the springs 54 and 56 to the solid line position illustrated in FIG. 3 and in which the clamping bar 46 is held in its retracted position spaced from the periphery of the drum 24. On the other hand, when either of the lobes 72*a* or 72*b* are positioned in the lobe recess 70*a* of the track 70, the springs 54 and 56 will move the bracket 52 and its counterpart on the opposite end of the drum 24 to position the clamping bar 46 in its sheet clamping position against the periphery of the drum 24**.

The trailing edge clamping bar 48 is similarly supported at opposite ends from a pair of brackets 74. While only one such bracket is illustrated in FIG. 2, it will be understood that the illustrated bracket is duplicated at the opposite end of the drum 24. The trailing edge clamping bar 48 is longer than the leading edge clamping bar 46 and correspondingly, the brackets 74 are positioned outwardly of the brackets 52 in an axial context. The brackets 74 are supported from the end caps 38 and 40, again by a pair of compression springs 76 and 78 contained between tabs 80 and tabs 82 struck out from the bracket 74 and the end cap 38, respectively. Also, the radial wall of the end cap 38 carries a pair of pins 84 which extend through radially orientated slots 86 in the bracket 74. Support of the bracket 74 from the end cap 38 is thus similar to support of the bracket 52 from the end face 50 of the drum 24 with the exception that the slots 86 in the bracket 74 are both radially oriented so that movement of the trailing edge clamping bar 48 from a retracted position spaced from the drum periphery as shown in FIGS. 3 and 4, for example, to a sheet clamping position against the drum periphery as shown in phantom lines in FIG. 4, is through a purely radial path.

As shown in FIG. 4, the bracket 74 is formed with an internal cam track 90, the major portion of which is circular but having a singular inwardly directed V-shaped projection **90*a*. The cam track 90 cooperates with a substantially circular cam 92 secured for rotation with the shaft 26 and with the twin-lobed cam 72 but in the plane of bracket 74. As may be seen from FIG. 4, the cam 92 has a V-shaped recess 92*a* which complements the configuration of the V-shaped projection 90*a* on the cam track 90 so that when the recess 92*a* registers with the projection 90*a*, the bracket 74 will be moved radially under the bias of the compression springs 76 and 78 to position the trailing edge clamping bar 48 in its sheet clamping position. At all other relative positions of the cam 92 and the track 90, the cam 92 will retain the bracket to position the clamping bar 48 in its retracted position against the bias of the compression springs 76 and 78**.

In FIGS. 2 and 4, it will be noted that the end cap 38 is supported for relative rotation with respect to the shaft 26 by a central bearing sleeve 94. The bearing sleeve frictionally engages the shaft 26 in a manner such that while relative rotation between the shaft 26 and the sleeve 94 is permitted, the end cap will normally be carried in rotation with the shaft 26 under a friction drag between the shaft and the bearing sleeve 94. While this form of yielding coupling of the end cap to the shaft 26 is preferred due to its simplicity, it is contemplated that other forms of couplings, such as a releasable clutch, may be substituted.

As shown in FIG. 2, the support 28 adjacent the end cap 38 carries a solenoid 96 having a plunger 98 which is capable of engaging an aperture 100 in the end plate 38 to retain the latter against rotation with the shaft 26. A similar solenoid 102 is provided to hold the drum 24 against rotation with the shaft 26 under certain conditions of operation to be explained below. Further, the drum 24 is supported from the shaft 26 through one-way clutches, one of which is shown in FIG. 2 and designated by the reference numeral 104. The one-way clutch 104 is of a well known commercially available type and operates so that the drum will be carried in rotation with the shaft 26 when the shaft is driven in one direction whereas the drum will not be carried in rotation with the shaft 26 during rotation thereof in the opposite direction. Thus, when the shaft 26 is rotated in a direction so that the drum 24 is released by the clutch 104, the solenoid 102 may be actuated to retain the drum 24 in predetermined angular positions.

As shown in FIGS. 2–4, each of the clamping bars 46 and 48 is shaped to present a major web portion against the periphery of the drum 24 to serve the sheet clamping function. Each of the clamps additionally includes a radial flange **46*f* and 48*f* respectively. While these radial flanges serve to strengthen the clamping bars against bending over their length, they serve two additional functions which are important to the clamping system of the present invention. Firstly, the radial flanges 46*f* and 48*f* by entering the axial slots 42 and 44 respectively, assure that both clamping bars 46 and 48 will be carried in rotation with the drum 24 when the clamps are in their operative sheet clamping position against the drum periphery. Secondly, the radial flange 46*f* serves as a stop for restricting movement of the leading edge of a sheet in its movement to the position in which it is clamped on the drum 24. The flange 48*f*** other hand, also serves to engage the trailing edge of a sheet for discharging it from a drum in a manner to be described more fully below.

In FIGS. 5–8 of the drawings, the sheet clamping system of the present invention is depicted schematically in four different operating conditions with respect to a sheet S fed from the supply stack 34, processed or printed while clamped to the drum 24 and then discharged to the delivery stack 36. Thus, in FIG. 5, the sheet S is fed from the top of the supply stack 34 by a single sheet feeding mechanism (not shown) in a direction generally tangentially to the drum 24 so that the leading edge of the sheet will pass between the trailing edge clamp 48 and the periphery of the drum 24 to the leading edge clamp 46 which, at the time of sheet feed, is in a retracted or open condition rather than closed as in FIG. 5. When the sheet is stopped by the radial flange 46*f*, the clamping bar 46 is moved to its sheet clamping position to seize the leading edge of the sheet S against the drum periphery. Because of the angular path taken by the clamping bar 46 in so moving to its clamping position, as described above, the sheet S will be pushed rearward by the flange 46*f* through a slight distance to assure precise positioning of its leading edge by the drum carried clamping bar 46.

Figure 5:
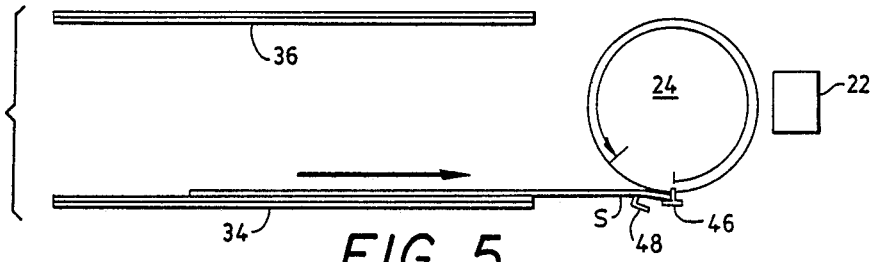
FIGS. 5–8, inclusively, are schematic illustrations representing respective phases of sheet handling and clamping operations using the clamping system of the present invention.
Figure 6:
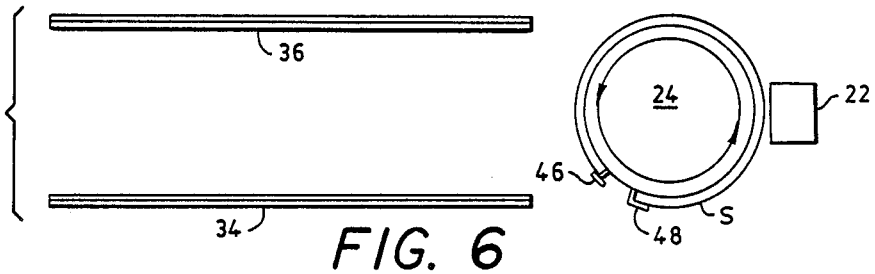

While the trailing edge clamp 48 is retained against rotation in the retracted position as shown in FIG. 5, the leading edge clamp 46 and the drum 24 are rotated to pull the sheet S through the trailing edge clamp until the trailing edge of the sheet S is in registry therewith. The trailing edge clamp is then moved to its clamping position over the trailing edge of the sheet S as shown in FIG. 6. With both clamps engaged, the sheet in printed by rotation of the drum relative to the print head 22.

Figure 7:
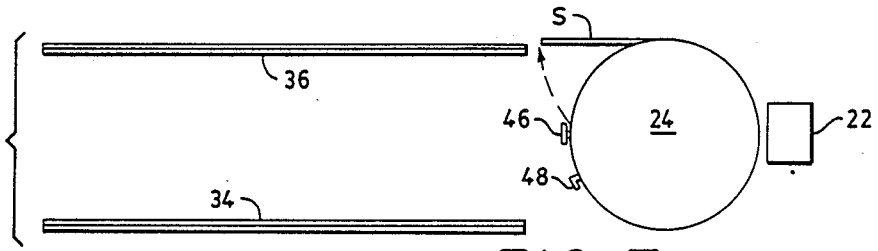
Figure 8:
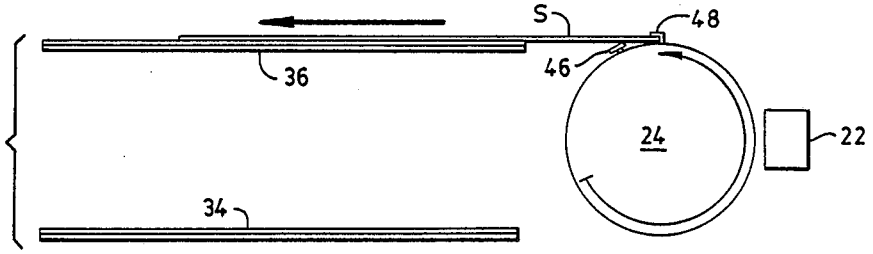

After the printing operation is completed, the drum is moved to the angular orientation illustrated in FIG. 7. In the position illustrated in FIG. 7, both clamps 46 and 48 are released from the sheet S to their retracted positions. Because of the path taken by the leading edge clamp 46 in moving from its sheet clamping position to its retracted position as determined by the angular orientation of the slot 64 in the brackets 52, the leading edge of the sheet S will spring free of the clamp 46 to the position shown in FIG. 7. The trailing edge of the sheet will move outwardly with the trailing edge clamp 48 but will remain engaged. Thereafter, and as shown in FIG. 8, the trailing edge clamp 48 is rotated with the drum 24 to discharge the sheet S to the delivery stack 36. The drum and the clamps 46 will then be returned to their initial position corresponding to that illustrated in FIG. 5 in accordance with a procedure to be detailed below.

Figure 9A:
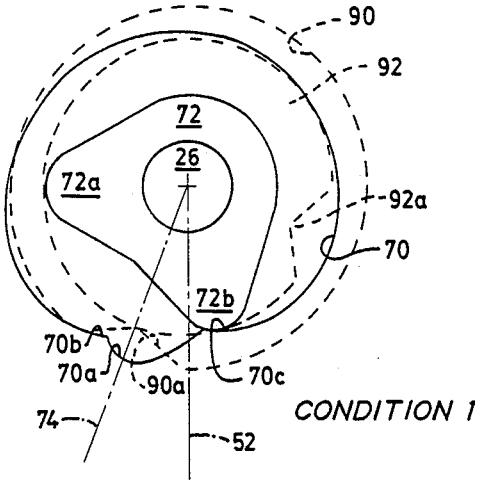
Figure 9B:
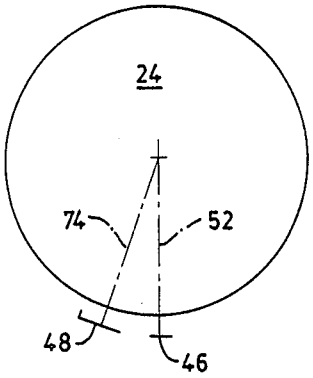

The manner in which the sheet handling operations depicted in FIGS. 5–8 are accomplished solely by controlled operation of the reversible stepping motor 32 in conjunction with the solenoids 96 and 102 will now be explained with reference to FIGS. 9A–15B of the drawings. These drawing figure sets represent in largely schematic format seven operating conditions depicting the relative angular positions of the clamping bar support brackets 52 and 74; the radial positioning of the clamping bars 46 and 48 relative to the periphery of the drum 24; the relative position of the cam 72 to the cam track 70 on the bracket 52; and the relative position of the cam 92 to the cam track 90 on the bracket 74. In FIGS. 9A and 9B, therefore, a first condition or "Condition 1" is represented in which the drum and clamping bars are positioned to receive a sheet in the manner described above with respect to FIG. 5. In this condition, the drum 24 and both end caps 38 and 40 are retained against rotation or grounded by their respective solenoids 102 and 96. The leading edge clamping bar 46 is in its open retracted position as a result of the cam lobe 72*b* engaging the cam track ledge 70*c*. The trailing edge clamp 48 is similarly in its open condition as a result of non-registry of the cam track projection 90*a* and the cam recess 92*a* in the cam 92.

Figure 10A:
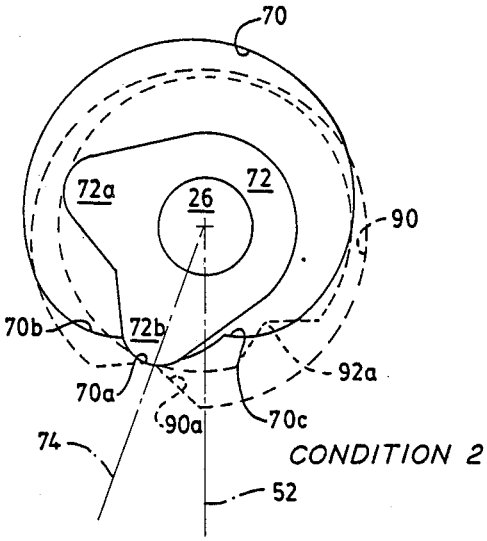
Figure 10B:
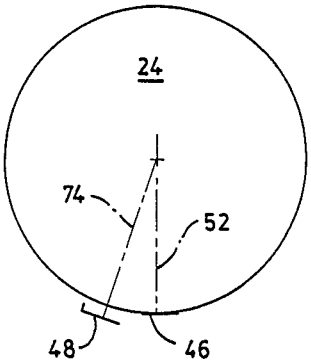
Figure 11A:
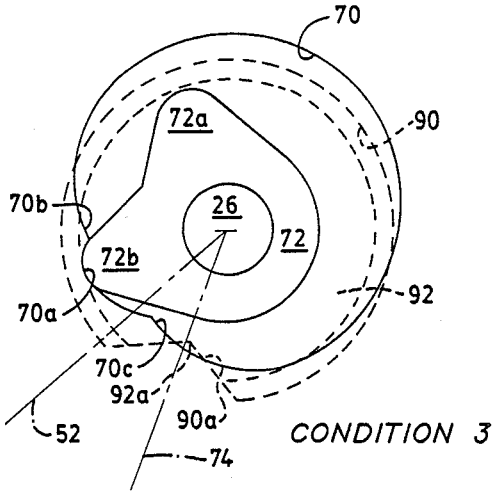
Figure 11B:
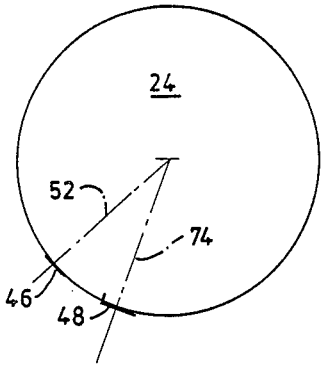
Figure 12A:
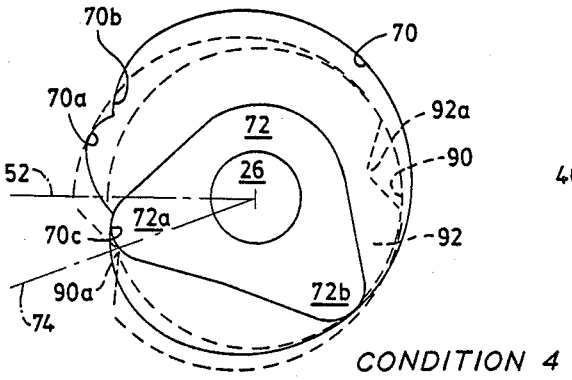
Figure 12B:
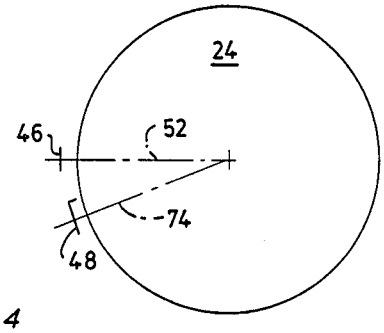

After a sheet is fed to the leading edge clamp 46 in the manner described with reference to FIG. 5, the stepping motor 32 is operated to drive the shaft 26 and thus the cam 72 in a clockwise direction from the position shown in FIG. 9A to the position shown in FIG. 10A and thereby establish Condition 2. In this condition, the lobe 72*b* of the cam 72 rests in the cam track lobe recess 70*a* to allow the springs 54 and 56 to bias the clamping bar 46 to its closed sheet clamping condition as shown in FIG. 10B. The stepping motor 32 is then operated to drive the shaft 26 in a counter-clockwise direction from the position represented in FIGS. 10A and 10B, carrying the drum 24 and the leading edge clamp 46 to the position shown in FIGS. 11A and 11B or Condition 3. During that movement of the drum 24, the trailing edge clamp 48 and its supporting brackets were grounded or retained against rotation but the cam 92 was moved with the shaft 26 and drum 24 so that the recess 92*a* came into registration with the projection 90*a* on the cam track 90 to allow the springs 76 and 78 to move the clamping bar 48 against the trailing edge of the sheet and the peripheral surface of the drum 24. The clamp retained sheet is then printed by rotation of the drum 24 and both end caps 38 and 40, all in a counter-clockwise direction in which the one-way clutch 104 engages the drum 24 and the shaft 26. After the printing operation on the drum-carried sheet is complete, the drum 24 is positioned as shown in FIGS. 12A and 12B to establish Condition 4. In this condition, the drum 24 and the end caps 38 and 40 are again grounded by the respective solenoids 102 and 96 and the shaft 26 rotated in a clockwise direction until the lobe 72*a* on the twin-lobe cam 72 engages the ledge 70*c* in the cam track 70. The cam 92 is similarly rotated so that the V-shaped recess 92*a* is once more out of registry with the complementing projection 90*a* on the cam track 90. This action of the cam results in both clamping bars 46 and 48 to be retracted away from the periphery of the drum 24. As explained above with reference to FIG. 7, the leading edge of the sheet carried by the drum 24 springs away from the periphery of the drum 24. Also in Condition 4, ejection of the sheet from the drum is effected by counter-clockwise rotation of the shaft 26, the drum 24 and of both end caps 38 and 40 due to the frictional drag of the bearing sleeve 94 on the shaft 26.

Figure 13A:
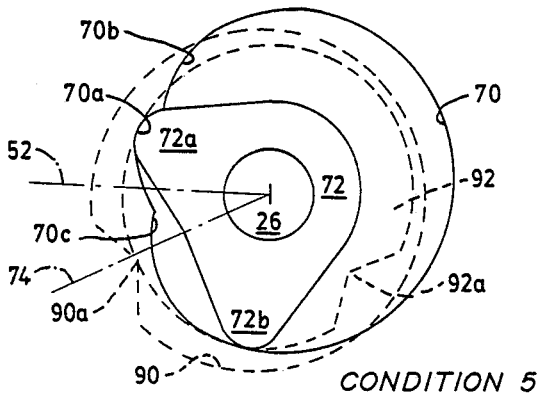
Figure 13B:
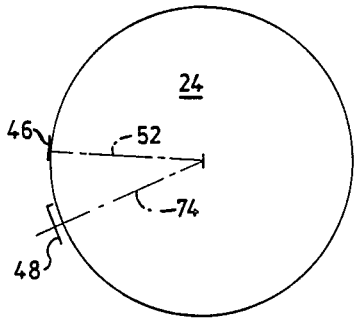
Figure 14A:
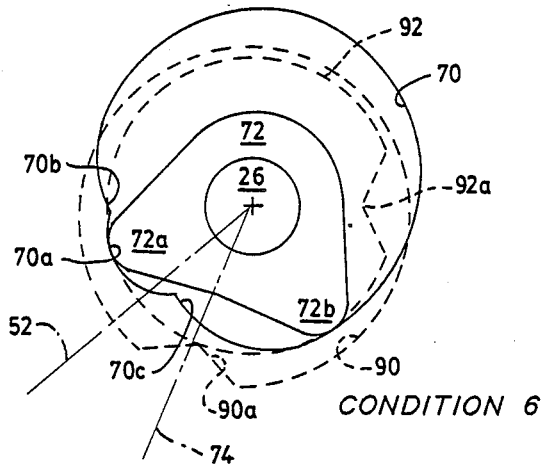
Figure 14B:
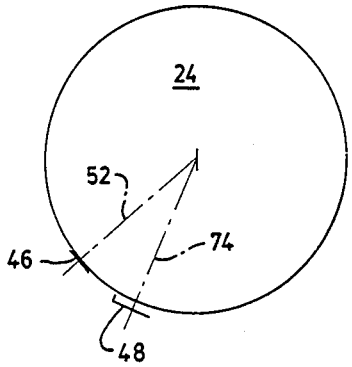
Figure 15A:
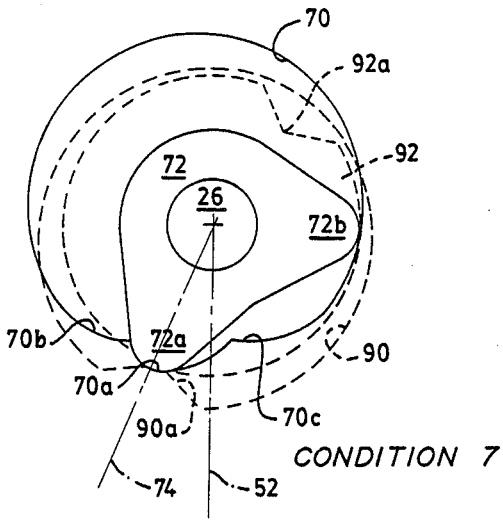
Figure 15B:
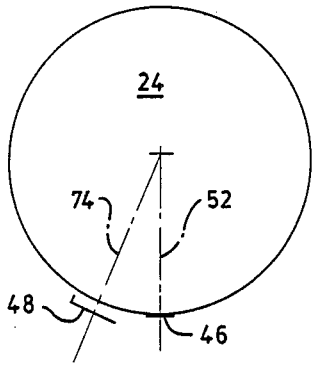

After the sheet has been delivered from the drum 24 with the clamping bars 46 and 48 positioned as in Condition 4, the drum 24 and clamping bars 46 and 48 resume the angular position of Condition 4 in a new Condition 5 shown in FIGS. 13A and 13B. In this condition, the drum 24 is again grounded by the solenoid 102 and the shaft 26 rotated in a clockwise direction so that the lobe 72*b* lies in the lobe recess 70*a* of the cam track 70 thus allowing the bracket 52 to return under its spring bias to move the clamping bar 46 to its closed position. Counter-clockwise rotation of the shaft 26 and of the drum 24 results in movement of both brackets 52 and 74 from the position of Condition 5 to that of Condition 6 as illustrated in FIGS. 14A and 14B. In Condition 6, the bracket 74 is again grounded to retain the open trailing edge clamping bar 48 in its "home" position. Thereafter, continued counter-clockwise rotation of the drum 24 and of the leading edge clamping bar 46 causes the latter to move through the trailing edge clamping bar 48 to its home position as illustrated in FIG. 15B. By comparison of Condition 7 of FIGS. 15A and 15B with Condition 1 of FIGS. 9A and 9B, it will be seen that the initial Condition 1 is achieved by grounding the drum 24 and end caps 38 and 40 in the position of Condition 7 (FIG. 15B) and operating the stepping motor 32 to drive the shaft 26 in a clockwise direction so that the lobe 72*b* again comes to rest on the ledge 70*c* to move the leading edge clamp 46 to its open position as in Condition 1.

Figure 16:
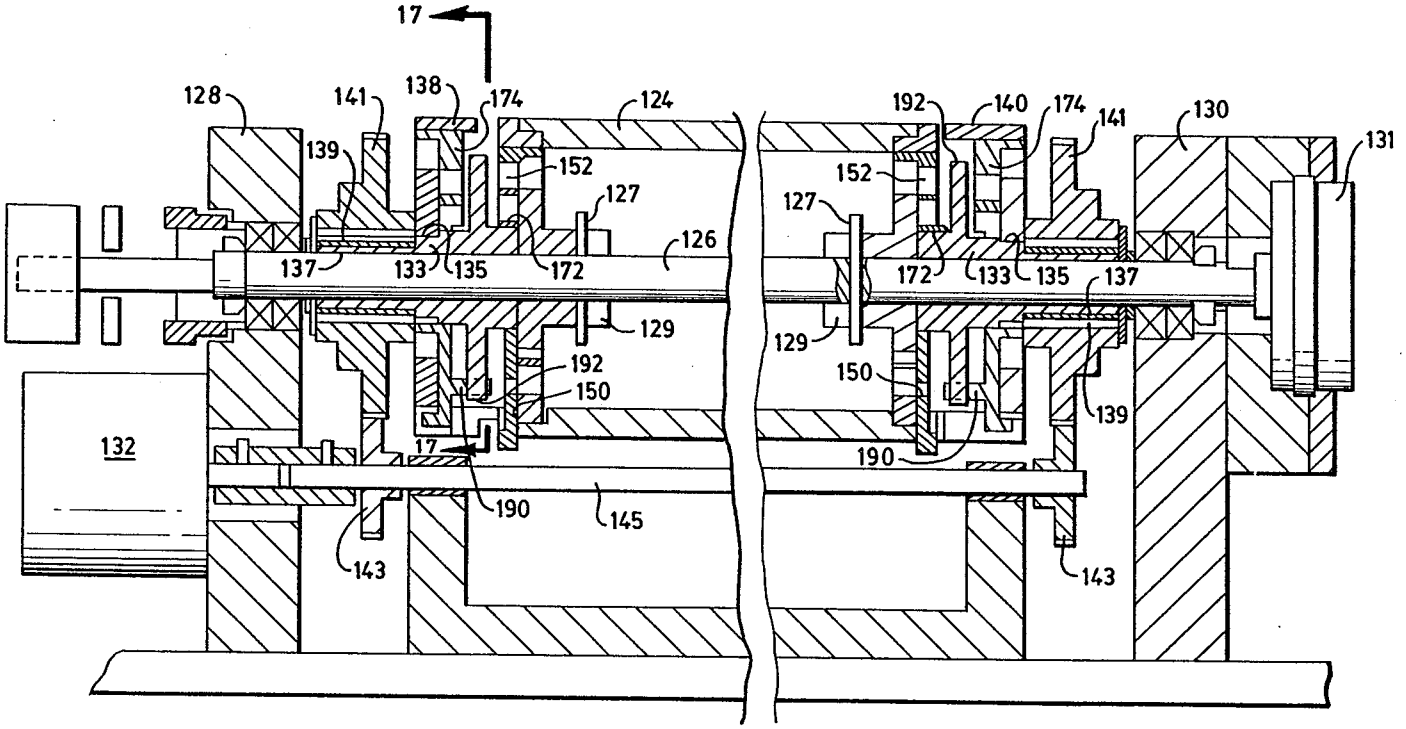
FIG. 16 is a cross section illustrating the several components of another embodiment of the present invention.
Figure 17:
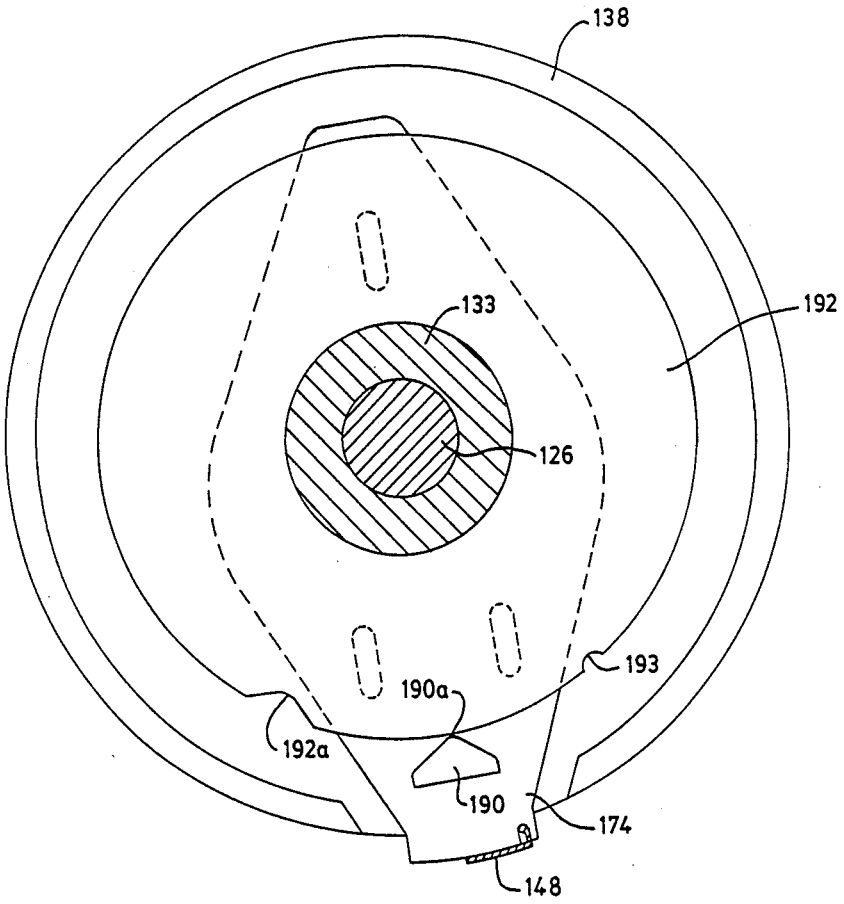
FIG. 17 is an enlarged cross section on line 11—11 of FIG. 10.

In FIGS. 16 and 17 of the drawings, an alternative embodiment of the invention is illustrated in which parts corresponding to parts identified in the previously described embodiment are designated by reference numerals having the same tens and digits values to which one hundred has been added. As may be seen by reference to FIGS. 16, therefore, the latter embodiment again includes a drum 124 having end faces 150 and supported for rotation on the axis of a shaft 126 journalled at opposite ends at spaced supports 128 and 130. Leading edge clamping bar brackets 152 are mounted against the drum end faces 150 to be rotatable about the axis of the shaft 126 at all times with the drum 124 and to be shiftable radially relative to the axis of the drum between sheet clamping and retracted positions in a manner similar to the previously described embodiment. Further, end caps 138 and 140 are supported on the axis of the shaft 126 at opposite ends of the drum 124 and are rotatably coupled for cooperation with trailing edge clamp brackets 174 in the manner of the previous embodiment.

In the embodiment of FIGS. 16 and 17, however, the drum 124 is coupled for direct rotation at all times with the shaft 126 through a suitable connection such as dowel pins 127 extending through the shaft 126 and through slotted hubs 129 on the drum 124. Moreover, the shaft 126 and the drum 124 are driven in working rotation, such as during high speed printing operations, in one direction only by a d.c. motor 131. A separate stepping motor 132 is provided for operation of the drum 124, end caps 138,140 and movement of the respective leading and trailing edge clamp brackets 152 and 174, during the sheet loading and unloading operations described above with reference to FIGS. 5–8.

In the embodiment of FIGS. 16 and 17, the clamping bracket actuating cams 172 and 192 are again provided to move and retain the respective brackets 152 and 174 during sheet loading and unloading operations in substantially the same manner as the cams 72 and 92 of the embodiment described with reference to FIGS. 1–15. In the embodiments of FIGS. 16 and 17, however, the cams 172 and 192 are provided on a common sleeve-like hub 133 which, though rotatable independently of the shaft 126 at low relative speeds, is frictionally fitted to the shaft 126 so that the hub 133 and cams 172 and 192 will rotate with the shaft 126 in the absence of relative torque causing rotation of the hub 133 and the shaft 126.

The cam hub sleeves 133 at opposite ends of the drum 124 are identical in configuration and as such, each includes a stepped external bearing surface 135 for supporting the respective end caps 138 and 140 in a manner permitting relative rotation between the end caps and the stepped journals 135 through preferably with a measure of frictional drag. Outboard of the stepped journalled surfaces 135, the sleeves 133 each extend as the inner race 137 of a one-way clutch 139, the outer race of which is provided in a relatively large spur gear 141. The one-way clutches 139 are of a design, as will be understood by those skilled in the art, so that in a given direction of drum rotation, that is, the direction of working rotation in which it is driven by the motor 131 for printing operations, the clutches 139 will cause the spur gears 141 to drive the hubs 133 when the rotational velocity of the gear 141 in the aforementioned direction exceeds that of the shaft 126. Correspondingly, when the speed of the shaft 126 exceeds that of the gears 141 in the same direction, the one-way clutches 139 will free wheel or allow the gears 141 to remain stationary without any substantial drag opposing rotation of the shaft 126. The gears 141 mesh with a pair of pinion gears 143 keyed or otherwise fixed for rotation with a counter shaft 145 driven by the stepping motor 132.

In light of the foregoing, it will be appreciated that during high speed working rotation of the drum in the performance of printing operations, for example, the drum 124 will be driven exclusively by and under the control of the d.c. motor 131. Because a sheet is clamped to the periphery of the drum during such working rotation, both sets of clamping brackets 152 and 174 as well as both end caps 138 and 140 will be carried in rotation with the drum 124. By virtue of operation of the one-way clutches 139 as above described, however, the gears 141 will not rotate with the shaft 126 and other components. During sheet loading and unloading operations, on the other hand, rotational movement of the drum 124 as well as the end caps 38 and cam hubs 133 will be controlled by operation of the stepping motor 132 in cooperation with actuation of the drum and end cap retaining solenoids in a manner described above with reference to FIGS. 1–15.

Although not shown in the cross section of FIG. 16, the configuration of the cam 172 and of the cam track (not shown) on the bracket 152 is the same as that described above with reference to the cam 72 and cam track 70. As shown in FIG. 17, however, the organization of the cam 192 and the bracket 174 is modified in a manner first to enable a larger diameter of the cam 192 and secondly to provide a detent interconnection of the bracket 174 and of the cam 192 when the trailing edge clamp 148 is in a retracted sheet discharging position. Thus, in the embodiment of FIGS. 16 and 17, the bracket 174 is modified so that instead of providing an internal cam track directly in the bracket to cooperate with the cam 192, the brackets 174 are provided with an axially projecting cam follower arm 190 having a configuration to establish a generally pointed cam follower surface **190*a*. The surface 190*a* engages in a relatively large V-shaped recess 192*a* in the periphery of the cam 192 to enable the bracket 174 and thus the trailing edge clamp to move to a clamping position against the outer periphery of the drum 124. When the follower surface 190*a* is positioned as shown in FIG. 17, the trailing edge clamping bar 148** is moved to its fully retracted or non-clamping position.

In addition to the recess **192*a*, the cam 192 is provided with a detent recess 193 on its outer periphery and spaced from the recess 192*a*. The position of the detent recess 193 is such that in the retracted position of the trailing edge clamping bar 48 beginning with the position illustrated in FIG. 7 of the drawings for the description of the corresponding clamping bar 48 of the first-mentioned embodiment, and also as shown in FIGS. 12*a* and 12*b* or in the described "Condition 4", the surface 190*a* will engage in the detent recess 193 to provide a detent-like coupling of the brackets 174 to the cams 192. Thus, the brackets 174 together with the end caps 138 and 140 will be caused to rotate with the cam 192 principally in the performance of the sheet unloading operation described above with reference to FIGS. 7 and 8**.

Because of the frictional coupling of the cam hub sleeve 133 with the shaft 126 and of the similar connection between the end caps 138,140 with the stepped journal 135 on the hub sleeve 133, rotation of the cam hub 133 without any obstruction to rotation of the end caps or of the drum 124 will effect rotation of these latter components directly with the hub 133. On the other hand, if the end caps 138,140 or the drum 124 are retained against rotation, such as by the solenoids described above with reference to FIG. 2 of the drawings, the hub 133 may continue rotation without rotation of the end caps or drum if one or the other of these latter parts are retained against rotation.

In light of the foregoing, operation of the embodiment illustrated in FIGS. 16 and 17 during sheet loading and unloading operations is essentially unchanged from the first-mentioned embodiment. In other words, operation of the motor 132 and rotation of the spur gears 141 to drive the cam hub sleeve 133 through the one-way clutches 139 can bring about relative rotation between the cams 192 and 172 and the respective brackets 152 and 174 depending on whether or not the drum or the end caps are retained against rotation. Also driving movement of the drum and end caps, as necessary for the loading and unloading operations described above with reference to FIGS. 5–8 and the cooperation of the cams as described with references to FIGS. **9*a*–15*b*, will apply to the embodiment of FIGS. 16 and 17**.

A principal advantage of the embodiment described in FIGS. 16 and 17 is that because the drum 24 is connected directly to the shaft 126 indexing control of the drum can be made significantly more precise than in the embodiment of FIGS. 1–15 where the drum 24 is coupled to the shaft 26 solely by way of the one-way clutch 104. On the other hand, the embodiment of FIGS. 1–15, being less complicated and requiring only a single reversible stepping motor 32 for its operation, provides advantages in applications where relatively large drum indexing tolerances can be accommodated.

Thus it will be seen that as a result of the present invention, a highly effective clamping system is provided for sheet handling drums and by which the stated objectives, among others, are completely fulfilled. It is contemplated and will be apparent to those skilled in the art from the preceding description and accompanying drawing illustrations, that modifications and/or changes may be made in the disclosed embodiment without departure from the invention. Accordingly, it is expressly intended that the foregoing description and accompanying drawings are illustrative only, not limiting, and that the true spirit and scope of the present invention will be determined by reference to the appended claims.

What is claimed is:

1. In a sheet clamping system for a rotatable drum having a leading edge clamping bar movable between retracted and clamping positions, a trailing edge clamping bar movable between radially displaced retracted and clamping positions, and means for operating said leading edge clamping bar, said trailing edge clamping bar and said drum so that a sheet passed between said drum and said trailing edge clamping bar in the retracted position thereof is clamped to said drum at its leading edge by said leading edge clamping bar, drawn through said trailing edge clamping bar while same is retained in a stationary retracted position during drum rotation with said leading edge clamping bar until the trailing edge of the sheet registers with and is clamped to the drum by said trailing edge clamping bar, the improvement comprising:

means for releasing said leading edge clamping bar to allow the leading edge of the sheet to spring free of said drum;

said trailing edge clamping bar having a major web portion adapted to lie against and clamp the trailing end of a sheet to the periphery of said drum and an inwardly directed radial flange portion in a position to extend past the trailing edge of the same sheet; and means including said trailing edge clamping bar in the retracted position thereof for delivering the sheet from said drum by the action of said radial flange pushing against the trailing edge of the sheet while the trailing end of the sheet underlies said major web portion free of clamping retention against the periphery of said drum.

2. The sheet clamping system of claim 1, wherein said drum includes an axially extending radial slot for receiving said trailing edge clamping bar radial flange portion when said trailing edge clamping bar is in said clamping position, thereby to ensure rotation of said trailing edge clamping bar with said drum in the clamping position thereof.

3. The sheet clamping system of claim 1, wherein said means for operating said leading edge clamping bar, said trailing edge clamping bar and said drum includes releasable retaining means for holding said trailing edge clamping bar in the retracted position thereof during rotation of said drum and yieldable coupling means for causing said trailing edge clamping bar to rotate with said drum when said retaining means is released.

4. The sheet clamping system of claim 3, wherein said yieldable coupling means comprises means for providing a frictional drag between said drum and said trailing edge clamping bar.

5. The sheet clamping system recited in claim 1 wherein said means for releasing said leading edge clamping bar includes means for moving said leading edge clamping bar at an angle to a radial plane of said drum containing the leading edge of the sheet so that said leading edge clamping bar is displaced clear of said sheet in moving from the clamping position to the retracted position thereof.

6. In a sheet clamping system for a rotatable drum having a leading edge clamping bar, a trailing edge clamping bar, means for supporting said leading edge clamping bar for rotation with said drum and for movement between a sheet clamping position against the drum periphery and a retracted position spaced from the drum periphery, and means for supporting said trailing edge clamping bar for movement between a sheet clamping position against the drum periphery and a retracted position spaced from the drum periphery, and means for selectively retaining said trailing edge clamping bar supporting means against rotation with said drum, the improvement comprising:

a rotatable shaft supporting said drum and said clamping bar supporting means;

means for rotatably driving said shaft in opposite directions of rotation;

cam means supported on said shaft, one of said cam means and said drum being fixed to said shaft whereas the other of said cam means and said drum is engagable with said shaft for rotation therewith in one direction of shaft rotation and released from rotation with said shaft in the other direction of shaft rotation, said cam means being rotatable relative to said clamping bar supporting means for adjusting said respective clamping bar supporting means between said retracted and sheet clamping positions; and means for effecting such relative rotation between said cam means and each of said clamping bar supporting means.

7. The sheet clamping system recited in claim 6, wherein said drum is coupled to said shaft in said one direction of shaft rotation and released from said shaft in said other direction of shaft rotation, and said cam means is fixed to said shaft.

8. The clamping system recited in claim 6, wherein said cam means cooperates with said means for supporting said trailing edge clamping bar to move said trailing edge clamping bar from the retracted to the clamping position thereof while said trailing edge clamping bar is retained against rotation with said drum and during rotation of said shaft and said drum.

9. The clamping system of claim 8 wherein said means for supporting said trailing edge clamping bar comprises a pair of end caps supported from said shaft at opposite end of said drum, and a pair of brackets supported from said end caps for radial movement relative to said shaft.

10. In a sheet clamping system for a rotatable drum having a leading edge clamping bar, a trailing edge clamping bar, means for supporting said leading edge clamping bar for rotation with said drum and for movement between a sheet clamping position against the drum periphery and a retracted position spaced from the drum periphery, and means for supporting said trailing edge clamping bar for movement between a sheet clamping position against the drum periphery and a retracted position spaced from the drum periphery, and means for selectively retaining said trailing edge clamping bar supporting means against rotation with said drum, the improvement comprising:

a rotatable shaft supporting said drum and said clamping bar supporting means;

means for rotatably driving said shaft in opposite directions of rotation;

means for rotatably coupling said drum to said shaft in one direction of shaft rotation and for releasing said drum from said shaft in the other direction of shaft rotation, respectively;

cam means fixed to said shaft for adjusting said clamping bar supporting means between said retracted and sheet clamping positions upon relative rotational movement between said cam means and said respective clamping bar supporting means;

means for effecting relative rotation between said cam means and both said clamping bar supporting means; and means for retaining said drum against rotation when said shaft and said drum are released, thereby to ensure rotation of said cam means relative to said means for supporting said leading edge clamping bar during rotation of said shaft in said other direction of rotation.

11. In a sheet clamping system for a rotatable drum having a leading edge clamping bar, a trailing edge clamping bar, means for supporting said leading edge clamping bar for rotation with said drum and for movement between a sheet clamping position against the drum periphery and a retracted position spaced from the drum periphery, and means for supporting said trailing edge clamping bar for movement between a sheet clamping position against the drum periphery and a retracted position spaced from the drum periphery, and means for selectively retaining said trailing edge clamping bar supporting means against rotation with said drum, the improvement comprising:

a rotatable shaft supporting said drum and said clamping bar supporting means;

means for rotatably driving said shaft;

means for rotatably coupling said drum to said shaft;

cam means supported on said shaft for adjusting said clamping bar supporting means between said retracted and sheet clamping positions upon relative rotational movement between said cam means and said respective clamping bar supporting means;

means for effecting relative rotation between said cam means and both said clamping bar supporting means; and means to support said cam means for rotation on said shaft under a yieldable friction drag and means for rotating said cam means independently of said shaft.

12. The sheet clamping system recited in claim 11 wherein said means for rotating said cam means comprises torque input means and a one-way clutch for rotatably coupling said torque input means and said cam means when the rotational velocity of said shaft is less than that of said torque input means.

13. The sheet clamping system recited in claim 12 wherein said means for rotatably driving said shaft comprises a first electric motor for driving said shaft and said drum at relatively high speeds during working operation of said drum after a sheet is clamped thereon and wherein said torque input means comprises a relatively low speed second electric motor.

14. The sheet clamping system recited in claim 13 wherein said torque input means additionally comprises a counter shaft driven by said second electric motor and gear means coupling said counter shaft to said cam means through said one-way clutch.

15. A sheet clamping system for rotatable drums, said system comprising:

a shaft having an axis and supported for rotation on said axis;

a drum and a pair of end caps supported by said shaft, one such end cap at each end of said drum;

means for rotatably coupling said drum and said shaft;

means rotatably supporting said end caps on the axis of said shaft so that said end caps may rotate with said shaft or be retained against rotation with said shaft;

a leading edge clamping bar extending axially of said drum at the periphery thereof;

a first pair of brackets for supporting said leading edge clamping bar, said brackets being rotatably fixed to opposite ends of said drum and shiftable radially of said axis to move said leading edge clamping bar between a retracted position spaced from the periphery of said drum and a sheet clamping position against the periphery of said drum;

a trailing edge clamping bar extending axially of said drum at the periphery thereof;

a second pair of brackets for supporting said trailing edge clamping bar, said second pair of brackets being fixed for rotation, one to each of said end caps and being shiftable radially of said axis to move said trailing edge clamping bar between a retracted position spaced from the periphery of said drum and a sheet clamping position against the periphery of said drum;

cam means supported by said shaft for cooperating with said first and second bracket pairs, respectively to control movement of said leading edge clamping bar and of said trailing edge clamping bar between their respective retracted and sheet clamping positions;

means for rotatably driving said shaft; and means for effecting relative rotation of said cam means and said bracket pairs to shift the position of said clamping bars, respectively.

16. The sheet clamping system recited in claim 15 wherein said means for rotatably coupling said drum and said shaft includes means to couple said drum and said shaft during rotation of said shaft in one direction of rotation and to release said drum from said shaft during rotation thereof in the opposite direction, respectively, said cam means is fixed to said shaft, said means for rotatably driving said shaft is reversible, and wherein said last mentioned means includes means for retaining said end caps against rotation during rotation of said shaft in said one direction of shaft rotation and to permit rotation of said drum with said shaft in said opposite direction while retaining said end caps against rotation.

17. The sheet clamping system recited in claim 16, wherein said means for coupling said drum and said shaft comprises a one-way clutch.

18. The sheet clamping system recited in claim 15, wherein said means rotatably supporting said end caps on said shaft comprise sleeve bearings to establish a frictional drag between said shaft and said drum.

19. A sheet clamping system as recited in claim 15, including means for controlling shifting movement of said first pair of brackets to move said leading edge clamping bar between said retracted and clamping positions through an angular path with respect to a radial plane containing said axis whereby movement of said leading edge clamping bar to said retracted position displaces said leading edge clamping bar from the leading edge of a sheet clamped to said drum.

20. A sheet clamping system as recited in claim 19, wherein said leading edge clamping bar includes an inwardly directed radial flange operative to position the leading edge of a sheet fed to the drum.

21. The clamping system of as recited in claim 15, wherein each of said first pair of brackets is mounted to an end of said drum by a pair of axial pins projecting from the drum end, said pins being located in a generally diametric relationship, one to each side of said axis, said first pair of brackets each including a pair of slots to receive said pins, said slots also being located in a generally diametric relationship, one to each side of said axis and between said axis and the periphery of said drum.

22. The clamping system recited in claim 21, wherein the one of said pair of slots located between said axis and said leading edge clamping bar is oriented at an angle to a radial plane containing said axis, thereby to cause said leading edge clamping bar to move through a radially angular path between said retracted and clamping positions.

23. The sheet clamping system of claim 15, comprising spring means for biasing said first pair of brackets toward said clamping position.

24. The sheet clamping system recited in claim 23, wherein said cam means moves said first pair of brackets in opposition to said spring means.

25. The sheet clamping system of claim 15, wherein said trailing edge clamping bar includes an inwardly directed radial flange and wherein said drum includes an axially extending peripheral slot to receive said flange when said trailing edge clamping bar is in said clamping position, thereby to ensure rotation of said trailing edge clamping bar in said clamping position in rotation with said drum.

26. The clamping system recited in claim 15, including means for retaining said end caps against rotation during rotation of said shaft, said last-mentioned means including fixed retractable stop means and indexing means on said end caps engagable by said stop means to index said end caps in a predetermined angular orientation.

27. The sheet clamping system recited in claim 15 including means to support said cam means for rotation on said shaft under a yieldable friction drag and means for rotating said cam means independently of said shaft.

28. The sheet clamping system recited in claim 27 wherein said means for rotatably coupling said drum and said shaft comprises means to establish a fixed connection of said drum and said shaft.

29. The sheet clamping system recited in claim 28 wherein said means for rotating said cam means comprises torque input means independent of said means for rotatably driving said shaft and one-way clutch means for rotatably coupling said torque input means and said cam means when the rotational velocity of said shaft is less than that of said torque input means.

30. The sheet clamping system recited in claim 29 wherein said means for rotatably driving said shaft comprises a first electric motor for driving said shaft and said drum at relatively high speeds during working operation of said drum after a sheet is clamped thereon and wherein said torque input means comprises a relatively low speed second electric motor.

31. The sheet clamping system recited in claim 30 wherein said torque input means additionally comprises a counter shaft driven by said second electric motor and gear means coupling said counter shaft to said cam means through said one-way clutch means.

* * * * *